US008181469B2

(12) United States Patent
Ichijo et al.

(10) Patent No.: US 8,181,469 B2
(45) Date of Patent: May 22, 2012

(54) REFRIGERATING METHOD AND REFRIGERATING SYSTEM UTILIZING GAS HYDRATE

(75) Inventors: Toshio Ichijo, Tokyo (JP); Kikuo Nakamura, Tokyo (JP)

(73) Assignee: Mitsui Zosen Plant Engineering Inc., Tokyo (JP)

( * ) Notice: Subject to any disclaimer, the term of this patent is extended or adjusted under 35 U.S.C. 154(b) by 1979 days.

(21) Appl. No.: 10/504,510

(22) PCT Filed: Feb. 19, 2003

(86) PCT No.: PCT/JP03/01776

§ 371 (c)(1),
(2), (4) Date: Aug. 13, 2004

(87) PCT Pub. No.: WO03/071199

PCT Pub. Date: Aug. 28, 2003

(65) Prior Publication Data

US 2005/0103027 A1 May 19, 2005

(30) Foreign Application Priority Data

Feb. 19, 2002 (JP) ..... 2002-040964

(51) Int. Cl.
*F25B 15/00* (2006.01)

(52) U.S. Cl. ..... 62/112; 62/54.3; 62/601

(58) Field of Classification Search ..... 62/112, 62/144, 45.1, 48.1, 54.3, 57, 601; 417/366; 585/15

See application file for complete search history.

(56) References Cited

U.S. PATENT DOCUMENTS 5,536,893 A * 7/1996 Gudmundsson ..... 585/15
6,180,843 B1 * 1/2001 Heinemann et al. ..... 585/15

FOREIGN PATENT DOCUMENTS

JP 57-157005 A1 9/1982
JP 04-340035 A1 11/1992
JP 05-180522 A1 7/1993
JP 06-058646 A1 3/1994
JP 10-122687 A1 5/1998
JP 2001-010990 A1 1/2001

OTHER PUBLICATIONS

International Search Report for PCT/JP03/01776 mailed on May 27, 2003.
Notification of International Preliminary Examination Report for PCT/JP03/01776 mailed on Mar. 16, 2004.

* cited by examiner

*Primary Examiner* — Melvin Jones
(74) *Attorney, Agent, or Firm* — Rader, Fishman & Grauer PLLC

(57) ABSTRACT

A refrigerating method and a refrigerating system utilizing a large decomposition heat absorbed at the time of decomposition of the gas hydrate and building up, by a pump, the pressure of liquid components generated due to the decomposition of gas hydrate and compressing only gas components by a compressor, the refrigerating method comprising the steps of generating the gas hydrate (H) by a hydrate generating reactor (11), decomposing the gas hydrate (H) into the liquid components (L) and the gas components (G) after depressurization to absorb heat, separating the decomposed liquid components (L) and gas components (G) from each other, building up the pressure of the liquid components (L) by the pump (16) and transferring to the hydrate generating reactor (11), and pressurizing and compressing only the gas components (G) by the compressor (17) and transferring to the hydrate generating reactor (11).

5 Claims, 2 Drawing Sheets

REFRIGERATING METHOD AND REFRIGERATING SYSTEM UTILIZING GAS HYDRATE

TECHNICAL FIELD

The present invention relates to a refrigerating method and a refrigerating system, particularly to a refrigerating method and a refrigerating system utilizing gas hydrate for a refrigerant.

BACKGROUND ART

A refrigerating system is widely used in fields such as food storage and air conditioning. As shown in FIG. 2, a refrigerating system 40 of the prior art is constituted by including a compressor 41, a condenser 42, a liquid receiver 43, an expansion valve (depressurizing unit) 44, and an evaporator (chiller) 45.

Moreover, ammonia and fluorocarbon gas which are very volatile liquids are used for refrigerants. The ammonia has a low temperature of −33.3° C. at the atmospheric pressure and when this cold liquid becomes a gas, it wrests heat from the surrounding area to refrigerate the area.

In the case of the refrigerating system 40 of the prior art, the compressor 41 sucks in and compress a cold gas G1 gasified by the evaporator 45 and compresses to generate a high-temperature high-pressure gas G2. The compressed gas G2 is cooled and condensed by water or air in the condenser 42 to generate a liquid L1. The refrigerant L1 becoming a liquid is temporarily stored in the liquid receiver 43 and then sent to the expansion valve 44 set to the entrance of the evaporator 45.

The high-temperature and high-pressure refrigerant L1 is expanded in the expansion valve 44 to depressurize it. When the refrigerant L1 passes through the expansion valve 44, some of the refrigerant L1 is evaporated and reduced in temperature to become a low-temperature and low-pressure refrigerant L2. The refrigerant L2 is evaporated in the evaporator 45 to wrest heat from the surrounding area of the evaporator 45, and when evaporated, it cools the surrounding area of the evaporator 45, and generates a refrigerating action.

However, the conventional refrigerating system uses a single fluid such as ammonia or fluorocarbon gas as a refrigerant for forming a refrigerating cycle and compresses the whole quantity of the refrigerant which is a single fluid, in a gas state by the compressor. Therefore, there are problems that the required motive power of the compressor increases, the system increases in size, and the power consumption increases.

That is, the "coefficient of performance (COP)" indicating the refrigeration efficiency obtained by dividing the refrigerating capacity by the thermal equivalent of compression, particularly, the "actual coefficient of performance =refrigerating capacity (kW)/motor(kW)" obtained by dividing the refrigerating capacity by the heat quantity corresponding to the output of a motor for operating a refrigerator deteriorates.

However, there is gas hydrate used for Japanese Patent Laid-Open Nos. 157005/1982, 340035/1992, 58646/1994, and 2001-10990 as the motive power source of a turbine and the like, cold heat storing material, and gas occlusion substance.

This gas hydrate is referred to as a hydrate clathrate compound or a gas clathrate compound, which is obtained by mixing a gas such as low-class carbon hydride with a liquid (hydrate) such as water. In the case of the decomposition heat of this gas hydrate, it is known that the decomposition heat in terms of the unit mass of gas is very large and becomes approx. 1.3 times larger than that of water.

The present invention is made to solve the above problems by obtaining the above knowledge, and its object is to provide a refrigerating method and a refrigerating system capable of using a large decomposition heat absorbed, when decomposing gas hydrate by utilizing gas hydrate as the refrigerant of a refrigerating system and capable of greatly decreasing the motive power necessary for the refrigerating system by boosting the liquid components generated due to decomposition of gas hydrate by a pump, compressing only the gas components by a compressor, and thereby, decreasing the gas quantity to be compressed by the compressor.

SUMMARY OF THE INVENTION

A refrigerating method of the present invention utilizing gas hydrate as a refrigerant comprises the steps of: generating gas hydrate by a hydrate generating reactor; depressurizing the generated gas hydrate; decomposing the depressurized gas hydrate into liquid components and gas components by a hydrate decomposing reactor to absorb heat; separating the decomposed gas components and the decomposed liquid components from each other; and boosting the decomposed liquid components by a pump and transferring it to the hydrate generating reactor, pressurizing and compressing the decomposed gas components by a compressor to transfer the gas components to the hydrate generating reactor, and is characterized in that an additive separated by the hydrate generating reactor is mingled in the liquid components transferred via a liquid line through an additive feed line connected to the hydrate generating reactor and the liquid line.

According to the refrigerating method, by utilizing gas hydrate as the refrigerant of a refrigerating system, it is possible to cool the surrounding area by using a large decomposition heat of the gas hydrate when decomposing the gas hydrate in a hydrate decomposing system and thereby efficiently absorbing heat. Therefore, refrigerating can be efficiently performed and the system becomes compact.

Therefore, by using sea water, cooling water, low-temperature water, brine and the like which are easy to use relatively, it is possible to make the brine of about −5° C. to 15° C.

Moreover, because the liquid components and gas components obtained by decomposing gas hydrate are separated into gas and liquid and the liquid components are boosted by a pump and only the gas components which are part of the gas hydrate are compressed by a compressor, the gas quantity passing through the compressor, that is, the gas quantity compressed by the compressor decreases compared to the case of the refrigerating system of the prior art and the required motive power of the compressor is extremely decreased.

For example, the required motive power of the compressor used for this refrigerating method becomes ⅓ to ⅙ compared to the case of a compressor shown in FIG. 2 of a conventional refrigerating system for compressing the whole gas quantity of a refrigerant by using the gas as a refrigerant.

Moreover, in the generating step of the gas hydrate, a mixed liquid or liquid components containing solids generated in the hydrate generating reactor is (or are) transferred to a cooler and cooled, and the cooled mixed liquid or liquid components containing the cooled solids are returned to the hydrate generating reactor, so temperature is lowered by radiating heat to external gas or liquid by the cooler and it is possible to efficiently generate gas hydrate.

Furthermore, the gas hydrate is cooled by the liquid components generated by the hydrate decomposing system before putting the gas hydrate in the hydrate decomposing system, so it is possible to increase a cold heat recovery quantity in the hydrate decomposing system.

Furthermore, a refrigerating system utilizing gas hydrate of the present invention is a refrigerating system utilizing gas hydrate as a refrigerant and having a hydrate generating reactor, a cooler, a depressurizing unit, a hydrate decomposing system, a pump, and a compressor, comprising: a hydrate line constituted by connecting in order the hydrate generating system, the depressurizing unit, and the hydrate decomposing system to transfer the gas hydrate; a gas line constituted by connecting in order the hydrate decomposing system, the compressor, and the hydrate generating reactor to transfer gas components decomposed from the gas hydrate; a liquid line constituted by connecting in order the hydrate decomposing system, the pump, and the hydrate generating reactor to transfer liquid components decomposed from the gas hydrate; and a cooling line constituted by connecting in order the hydrate generating reactor, the cooler, and the hydrate generating reactor to cool and return a mixture solution or liquid components solids generated in the hydrate generating reactor, the system further comprising an additive feed line connecting the hydrate generating reactor and the liquid line to each other for mingling an additive separated by the hydrate generating reactor into the liquid components transferred via the liquid line.

This configuration makes it possible to execute the above refrigerating method utilizing gas hydrate.

Moreover, in the case of the above refrigerating system utilizing gas hydrate, a cold heat recovery unit for cooling the gas hydrate in the hydrae line by the liquid components transferred through the liquid line is set between the hydrate generating reactor and the depressurizing unit in the hydrate line, so it is possible to cool gas hydrate by the liquid components generated by the hydrate decomposing system and then put the gas hydrate in the hydrate decomposing system and increase the cold heat recovery quantity by the hydrate decomposing system.

Furthermore, in the case of the above refrigerating system utilizing gas hydrate, in order to mix an additive separated by the hydrate generating reactor in the liquid components transferred through the liquid line, an additive line for connecting the hydrate generating reactor and the liquid line is set, so it is possible to circulate the additive and efficiently accelerate the generation of gas hydrate.

DETAILED DESCRIPTION OF THE PREFERRED EMBODIMENT

A refrigerating method and a refrigerating system utilizing gas hydrate of the present invention are described below by referring to FIG. 1.

A refrigerating system used for a refrigerating method utilizing gas hydrate of the present invention uses gas hydrate (gas clathrate compound) H constituted by gas components G of low-class hydrocarbon such as ethane and liquid components L such as water (or oil) as a refrigerant.

As the gas components G for forming the gas hydrate H, it is possible to use a single component of low-class hydrocarbon such as methane, ethane, propane, and butane, or a mixed gas of a plurality of components of these substances. Moreover, it is possible to use water or oil as the liquid components L.

Furthermore, to adjust a condition of generating and decomposing the gas hydrate H in a refrigerating system 10, it is also possible to use an additive A. As the additive A to be added to the liquid components L of the gas hydrate H, there are substances referred to as a hydration clathrate accelerator, a hydrate stabilizer, and a hydrate decomposer. In this case, however, the hydration clathrate accelerator for accelerating generation of hydrate is used. By using the hydration clathrate accelerator, it is possible to lower the pressure and raise temperature when generating hydrate.

As the hydrate clathrate accelerator A, it is possible to use any one of 1,3-dioxolane, tetrahydrofuran, furan, cyclobutanone, cyclopentanone, special saline, lecithin, PVA, PVCap, acetone, methanol, common salt, glycol, and so on.

Figure 1:
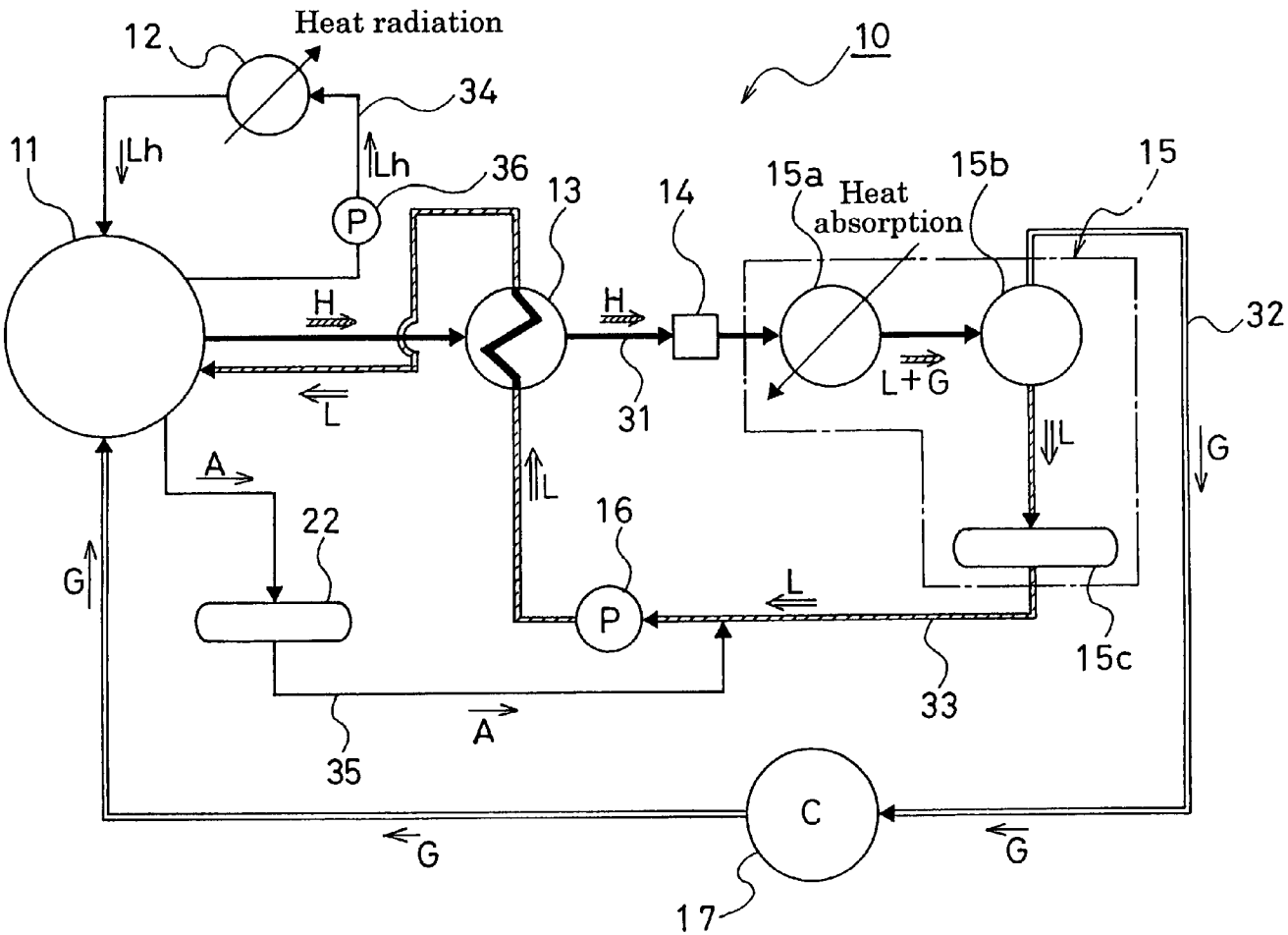
FIG. 1 is an illustration showing a configuration of a refrigerating system of an embodiment of the present invention.

Moreover, as shown in FIG. 1, the refrigerating system 10 is constituted by including a hydrate generating reactor 11, a cooler 12, a cold heat recovery unit 13, a depressurizing unit 14, a hydrate decomposing system (chiller) 15, a pump 16, and a compressor 17.

Furthermore, the refrigerating system 10 connects units by a hydrate line 31, a gas line 32, a liquid line 33, a cooling line 34, and an additive line 35.

The hydrate line 31 is constituted by connecting the hydrate generating reactor 11, the cold heat recovery unit 13, the depressurizing unit 14, and the hydrate decomposing system 15 in order and the gas line 32 is constituted by connecting the hydrate decomposing system 15, the compressor 17, and the hydrate generating reactor 11 in order.

Moreover, the liquid line 33 is constituted by connecting the hydrate decomposing system 15, the pump 16, the cold heat recovery unit 13, and the hydrate generating reactor 11 in order and the cooling line 34 is constituted by connecting the hydrate generating reactor 11, the pump 36, the cooler 12, and the hydrate generating reactor 11 in order.

Furthermore, the additive line 35 is constituted by connecting the hydrate generating reactor 11, an additive catching vessel 22, and the liquid line 33 at the upstream side of the pump 16.

In the refrigerating system 10, the slurry-like gas hydrate H generated in the hydrate generating reactor 11 is cooled at the cold heat recovery unit 13 by the liquid components L pressurized and sent to the hydrate generating reactor 11 from the pump 16 and then enters the depressurizing unit 14 and is decompressed and absorbs heat from the surrounding area in the hydrate decomposing system 15 at the downstream side of the depressurizing unit 14 and is decomposed into the gas components G and liquid components L.

The hydrate decomposing system 15 is constituted by a hydrate decomposing reactor 15*a*, a liquid-gas separator 15*b*, and a liquid receiver 15*c*, which can efficiently cool the surrounding area by using a large decomposition heat of the gas hydrate H when decomposing the gas hydrate H.

The hydrate decomposing reactor 15*a*, the liquid-gas separator 15*b*, and the liquid receiver 15*c* can be set as an integrated system or when the absorbed heat quantity is large, a heat sink can be set to the external circulating line of the integrated system. However, it is also possible to form the reactor 15*a*, the separator 15*b*, and the receiver 15*c* by separated vessels as described above.

Moreover, the liquid components L and gas components G decomposed in the hydrate decomposing reactor 15*a* are separated in the liquid-gas separator 15*b* and the liquid components L stored in the liquid receiver 15*c* is pressurized by the pump 16 in the liquid line 33 to cool the gas hydrate H in the cold heat recovery unit 13 before depressurized and sent to the hydrate generating reactor 11. Furthermore, the separated gas components G is pressurized and compressed by the compressor 17 in the gas line 32 and sent to the hydrate generating reactor 11.

In the case of the above configuration, liquid and gas are separated by the hydrate decomposing system 15 and then, the gas components G and liquid components L decomposed by the gas hydrate H are separately boosted. Therefore, because the liquid components L is boosted by the pump 16 and sent to the hydrate generating reactor 11, the required motive power can be decreased.

Figure 2:
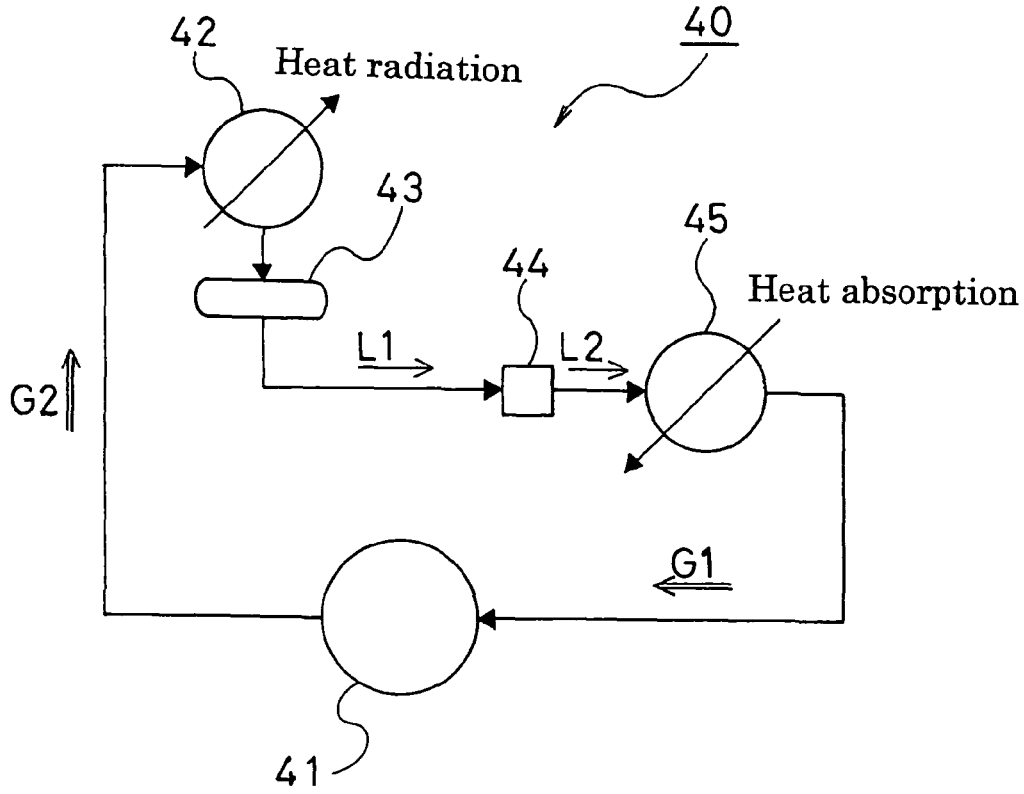
FIG. 2 is an illustration showing a configuration of a refrigerating system of the prior art.

Moreover, because the gas components G to be compressed by the compressor 17 are part in the gas hydrate H, the gas quantity decreases compared to the case of the refrigerating system of the prior art, the required motive power of the compressor 17 is extremely decreased, and the required motive power of the compressor 17 having the configuration in FIG. 1 becomes ⅓ to ⅙ compared to the case of the compressor 41 of the conventional refrigerating system 40 for compressing the whole gas quantity of a refrigerant by using the gas as the refrigerant as shown in FIG. 2.

Furthermore, the hydrate generating reactor 11 is kept at a high pressure, a mixed liquid or liquid components Lh containing solids are heat-exchanged with an external cooling medium formed by sea water, cooling water, low-temperature water, brine and the like by the cooler 12 to radiate the heat of the gas hydrate H side to the external cooling medium and cooled to return to the hydrate generating reactor 11 and cool the gas hydrate H side.

Furthermore, the additive A for accelerating generation of the gas hydrate H separated when generating the gas hydrate H in the hydrate generating reactor 11 is supplied to the upstream side of the pump 16 through the additive line 35 to mix it with the liquid components L.

The gas components G are incorporated into the liquid components L in a high-pressure and low-temperature state by cooling by the cooler 12 and boosting by the pump 16 and the compressor 17, and the gas hydrate H is generated.

By repeating the above refrigerating cycle, a refrigerating function is exhibited in the hydrate decomposing system 15.

Moreover, in the case of the hydrate generating reactor 11, it is important to keep proper pressure and temperature, because the pressure resistance of a vessel causes a undesirable problem when the pressure is high, the gas hydrate H is not generated when the pressure is low, the gas hydrate H is decomposed when the temperature is high, and the generation efficiency of the gas hydrate H is deteriorated through freeze of the liquid components L when the temperature becomes 0° C. or lower.

Therefore, circulating quantities of the gas hydrate H, the liquid components L, and the gas components G, and heat exchange quantities of the hydrate decomposing system 15, the cold heat recovery unit 13, and the cooler 12 are controlled by a sensor and a pressure controller not-illustrated to adjust the pressure and the temperature of each unit.

Pressures and temperatures of units are shown below. In the case of pressures, the hydrate generating reactor 11 uses 1.0 MPa to 10 MPa and the depressurizing unit 14 uses 2.0 MPa or lower at its downstream side. The temperature of the external cooling medium of the cooler 12 ranges between 10° C. and 35° C. and the temperature of the brine which is cooled in the hydrate decomposing system 15 and supplied to the outside ranges between −5° C. and 15° C.

Moreover, balanced data is shown below. When using a mixed gas of methane and ethane and an additive, a pressure of 5.0 MPa and a temperature of 25° C. are obtained at the high-pressure side where the gas hydrate H is generated and 0.5 MPa and 2° C. are obtained at the low-pressure side where the gas hydrate H is decomposed and the gas components G are generated.

Then, calculation examples of decomposition heat of the gas hydrate H are shown below. In the case of methane hydrate having a weight ratio of methane:water of 1:6.75, MW (molecular weight) is 125, the molecular decomposition heat is 12.95 kcal/mol, and the decomposition heat for 1 kg of hydrate is 103.6 kcal/kg.

Moreover, in the case of ethane hydrate having a weight ratio of ethane:water of 1:4.60, MW is 168, the molecular decomposition heat is 16.16 kcal/mol, and the decomposition heat for 1 kg of hydrate is 102.1 kcal/kg.

Furthermore, in the case of propane hydrate having a weight ratio of propane:water of 1:6.95, MW is 350, the molecular decomposition heat is 30.88 kcal/mol, and the decomposition hear for 1 kg of hydrate is 88.2 kcal/kg.

As described above, according to a refrigerating method and a refrigerating system utilizing the gas hydrate H of the present invention, by utilizing the gas hydrate H as the refrigerant of the refrigerating system, refrigeration can be efficiently made because a large decomposition heat absorbed when decomposing the gas hydrate H can be used.

Therefore, it is possible to make the brine of approx. −5° C. to 15° C. by using sea water, cooling water, low-temperature water, brine and the like which can be comparatively easily used.

Moreover, because the liquid components L generated through decomposition of the gas hydrate H are boosted by the pump 16 to compress only the gas components G by the compressor 17, it is possible to decrease the gas quantity to be compressed by the compressor 17 and extremely decrease the motive power necessary for a refrigerating system. Therefore, the present invention makes it possible to decrease the required motive power of a compressor to approx. ⅓ to ⅙ compared to a compressor of a conventional refrigerating system for compressing the whole gas quantity of a refrigerant by using the gas as a refrigerant.

Industrial Applicability

The present invention provides a refrigerating method and a refrigerating system capable of using a large decomposition heat absorbed through decomposition of gas hydrate and extremely decreasing the motive power necessary for the refrigerating system by boosting a liquid components generated through decomposition of the gas hydrate by a pump and compressing only a gas components by a compressor.

Therefore, the present invention can be used as a refrigerating method and a refrigerating system widely used in fields such as food storage, air conditioning and the like.

What is claimed is:

1. A refrigerating method utilizing gas hydrate as a refrigerant, comprising the steps of :

generating gas hydrate by a hydrate generating reactor;

depressurizing said generated gas hydrate;

decomposing said depressurized gas hydrate into liquid components and gas components by a hydrate decomposing reactor to absorb heat;

separating said decomposed gas components and said decomposed liquid components from each other; and boosting said decomposed liquid components by a pump and transferring it to said hydrate generating reactor, pressurizing and compressing said decomposed gas components by a compressor to transfer said gas components to said hydrate generating reactor, characterized in that an additive separated by the hydrate generating reactor is mingled in the liquid components transferred via a liquid line through an additive feed line connected to the hydrate generating reactor and the liquid line.

2. The refrigerating method utilizing gas hydrate according to claim 1, wherein in said generating step of said gas hydrate, a mixed liquid or liquid components containing solids generated in said hydrate generating reactor is (or are) transferred to a cooler and cooled, and said cooled mixed liquid or liquid components containing said cooled solids are returned to said hydrate generating reactor.

3. The refrigerating method utilizing gas hydrate according to claim 1 or 2, wherein said gas hydrate is cooled by the liquid components generated by said hydrate decomposing system before putting said gas hydrate in said hydrate decomposing system.

4. A refrigerating system utilizing gas hydrate as a refrigerant and having a hydrate generating reactor, a cooler, a depressurizing unit, a hydrate decomposing system, a pump, and a compressor, comprising:

a hydrate line constituted by connecting in order said hydrate generating system, said depressurizing unit, and said hydrate decomposing system to transfer the gas hydrate;

a gas line constituted by connecting in order said hydrate decomposing system, said compressor, and said hydrate generating reactor to transfer gas components decomposed from the gas hydrate;

a liquid line constituted by connecting in order said hydrate decomposing system, said pump, and said hydrate generating reactor to transfer liquid components decomposed from the gas hydrate; and a cooling line constituted by connecting in order said hydrate generating reactor, said cooler, and said hydrate generating reactor to cool and return a mixture solution or liquid components containing solids generated in the hydrate generating reactor;

the system further comprising an additive feed line connecting the hydrate generating reactor and the liquid line to each other for mingling an additive separated by the hydrate generating reactor into the liquid components transferred via the liquid line.

5. The refrigerating system utilizing gas hydrate according to claim 4, further comprising a cold heat recovery unit for cooling the gas hydrate in said hydrate line by said liquid components transferred through said liquid line, wherein said cold heat recovery unit is set between said hydrate generating reactor and said depressurizing unit in said hydrate line.

* * * * *